United States Patent [19]

Aug et al.

[11] 4,235,496

[45] Nov. 25, 1980

[54] CIRCUIT BOARD AND CARD INTERCONNECTION SYSTEM

[75] Inventors: Conrad J. Aug, Preston; Arthur P. Reckinger, Jr., Rochester, both of Minn.

[73] Assignee: International Business Machines Corporation, Armonk, N.Y.

[21] Appl. No.: 954,134

[22] Filed: Oct. 23, 1978

[51] Int. Cl.[3] ..... H01R 13/629; H01R 23/72

[52] U.S. Cl. ..... 339/45 M; 339/17 M; 339/75 MP; 361/413

[58] Field of Search ..... 339/17 L, 17 M, 17 LM, 339/17 LC, 75 M, 75 MP, 176 MP, 45 R, 45 N; 361/399, 412, 413, 415

[56] References Cited

U.S. PATENT DOCUMENTS

| | | | |
|---|---|---|---|
| 3,300,686 | 1/1967 | Johnson et al. | 339/17 M UX |
| 3,591,834 | 7/1971 | Kolias | 339/17 LM X |
| 4,155,109 | 5/1979 | Finch et al. . | |

*Primary Examiner*—Richard B. Lazarus
*Assistant Examiner*—Eugene F. Desmond
*Attorney, Agent, or Firm*—Robert W. Lahtinen

[57] ABSTRACT

Interconnection between a large planar electronic printed circuit board and a plurality of relatively smaller electronic printed circuit cards is accomplished by connecting the planar board to an array board by means of elongated interposer connectors. The array board contains a plurality of positions which accommodate the plugging of electronic printed circuit cards and cables. A mechanical ejection system allows the planar board to be removed from the system without disturbing the cards, cables or the interposer connection to the array board.

6 Claims, 8 Drawing Figures

CIRCUIT BOARD AND CARD INTERCONNECTION SYSTEM

DESCRIPTION

1. Background of the Invention

The invention relates to an interconnection system for large printed circuit boards containing electronic circuits and smaller printed circuit cards and particularly to a system having elongated interposer connectors which make bridging contact between the large printed circuit board and a similar sized array board. The array board is a printed circuit board with interconnections between pins which plug into the interposers, pins which connect to signal and power cables and pins which mate with printed circuit cards.

The invention further includes mechanical means for retaining the interposers in engagement with the array board while disengaging the planar board from the interposers.

2. Description of the Prior Art

The increasingly high density of electronic circuit modules has led to the adoption of packaging and interconnection systems in which logic and processor modules are mounted on a relatively large planar printed circuit board. Conductive strips interconnect the modules and lead to pins or lands which provide means for connecting the planar board to other parts of the system.

In a typical system the planar board has a large number of cables or printed circuit cards connected to it. Conventional multi-pin sockets are inadequate to make the large number of connections which are required. For example, 500 pins may be necessary in a typical system. A single socket having this many contacts will require substantial insertion and withdrawal force which may stress the board to the point of failure. Further, the single socket approach provides constraints on the location of signal and power conductors which leads to a configuration far from optimum.

Other typical systems have a planar board with pins arranged to mate with cable connectors. While this arrangement may reduce the stress associated with insertion and withdrawal it has the substantial disadvantage that the unplugging and plugging of cables may very easily produce an error leading to faulty operation or destruction of circuits. Further, the time required to plug and unplug many cables may increase the cost of maintaining the system to the point where it is impractical to use planar board substitution as a troubleshooting technique.

There are further disadvantages in the prior art systems which are a consequence of the cable interconnections. The position of cables may vary from system to system and even within a system. It is sometimes difficult to predict what problems will be created by crosstalk and electrical noise. Also, the length of the connection between circuits is an increasingly significant factor as such circuits achieve faster and faster operating speeds.

SUMMARY

The primary objects of this invention are to provide an improved circuit board connection system which:

(a) eliminates the need for cables in connecting cards to boards;

(b) provides rigid, reproducible interconnections between cards and boards;

(c) provides for removal of boards without distorting the board or unplugging any cables;

(d) accomplishes all of the foregoing without limiting the number of connections which can be provided.

These and other objects are achieved by the use of relatively short, elongated rigid interposers which connect the planar board to an array board. Each interposer has a polarized plug at one end which engages 24 pins on the planar board. The other end of the interposer has a polarized plug which engages a like number of pins in the array board. The planar board and the array board are in parallel relationship with the interposers between them at right angles.

The side of the array board opposite to the planar board has a plurality of sockets for printed circuit cards, signal cables and power cables. A pair of retainer members fastened to the array board hold the interposers in engagement with the pins on the array board. A pair of intermated screw actuated counter rotating levers on the retainer members operate to disengage the planar board from the interposers without disrupting the connection to the cards or cables. The use of polarized connectors, fasteners and alignment means prevents assembly in a fashion which would damage the system or result in incorrect operation.

DESCRIPTION OF THE DRAWINGS

With reference to FIG. 1, the planar printed circuit board 1 carries a plurality of integrated circuit modules 2 mounted in conventional fashion. Printed circuit board 1 is a multi-layer epoxy glass laminate having copper conductors which interconnect modules 2 with each other and transversely projecting contact means such as pins 3. For the purpose of simplification only a few of the pins 3 are shown in FIG. 1. It will be understood that these pins are arranged in four rows along dotted lines 4 at one end of circuit board 1 and four rows along dotted lines 5 at the other end of circuit board 1. The pins 3 are spaced to accommodate the plugging of connectors. Certain pins are omitted in the area between the pins which are common to adjacent connectors.

Figure 1:
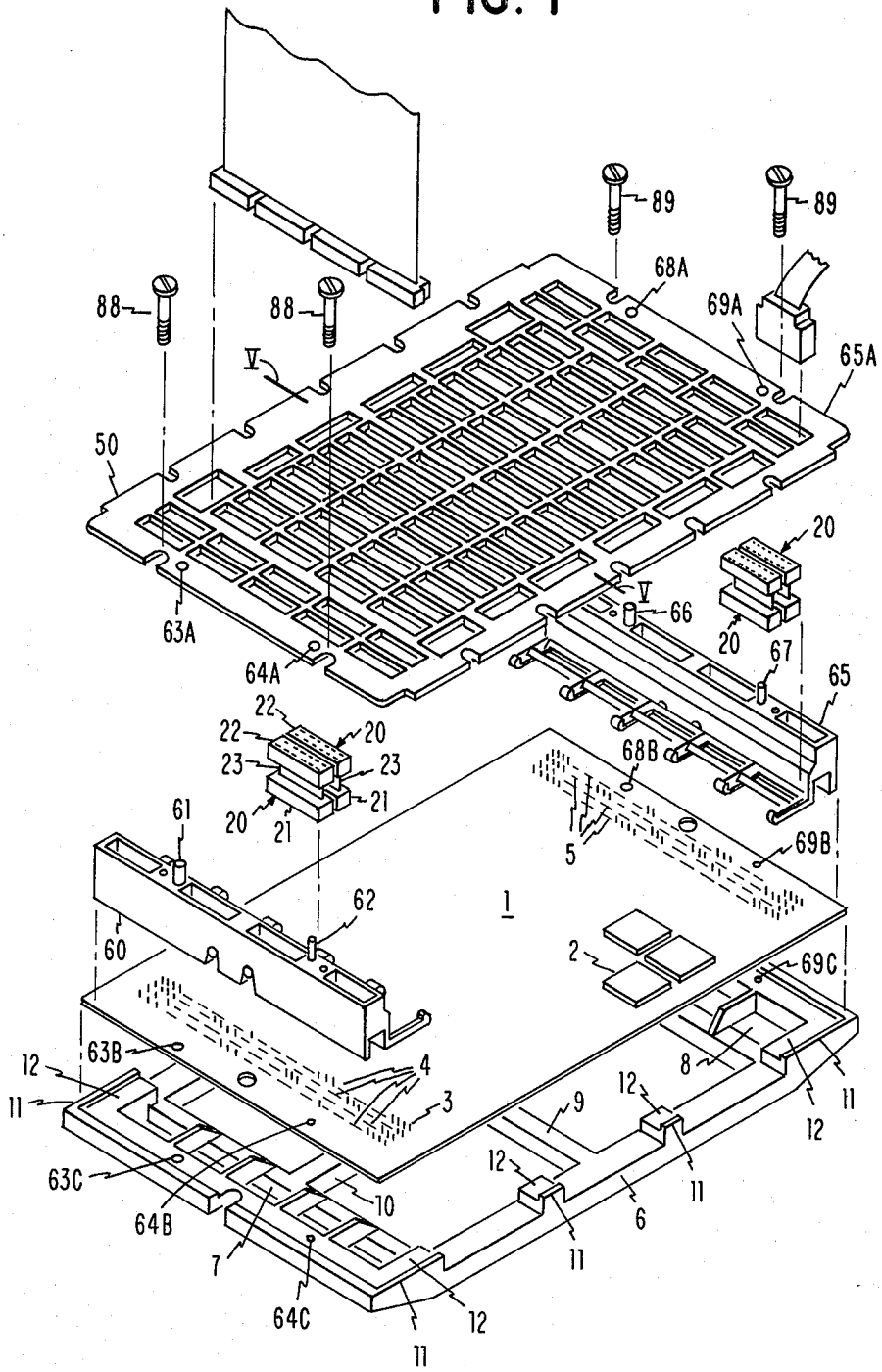
FIG. 1 is an exploded isometric view of an electronic system embodying the invention.
Figure 4:
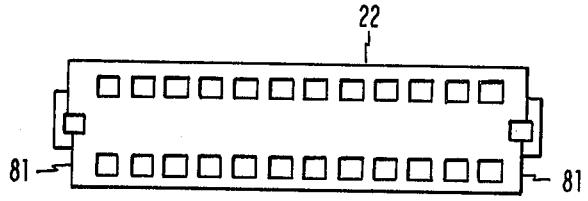
FIG. 4 is an end view of the interposer showing the second connector means.

Since the circuit board 1 is relatively thin and can therefore be easily damaged by flexing or bending, a stiffener 6 is used to provide support. The stiffener 6 is molded from a non-conductive plastic material. The circuit board 1 is affixed to stiffener 6 by any suitable means such as plastic screws or adhesives. Aperture sets 7 and 8 at opposite ends of stiffener 6 provide clearance for the other ends of pins 3. A series of ribs 9 and 10 reinforce the stiffener to prevent circuit board 1 from bending. A shoulder 11, which extends around the periphery of stiffener 6 coacts with a mounting surface 12 to accurately position and retain circuit board 1 in an unstressed position.

While only a few modules 2 have been shown it will be understood that many more could be mounted on circuit board 1. Additionally, discrete semiconductor devices such as diodes or transistors could be mounted. It is also possible to mount resistors and capacitors and other components on circuit board 1.

With planar circuit board 1 affixed to stiffener 6 a unitary assembly is provided which may be connected to the rest of the system through the pins 3. The assembly becomes a single, high-function, electronic device which is easily connected to, and disconnected from, the rest of the system.

Connection to the assembly of circuit board 1 and stiffener 6 is made by a plurality of plugable elongated interposer means 20. Although four such interposers are shown it will be understood that the system shown accommodates twenty such elements, ten at each end of board 1, and the usual configuration would include the full capacity of twenty.

Figure 2:
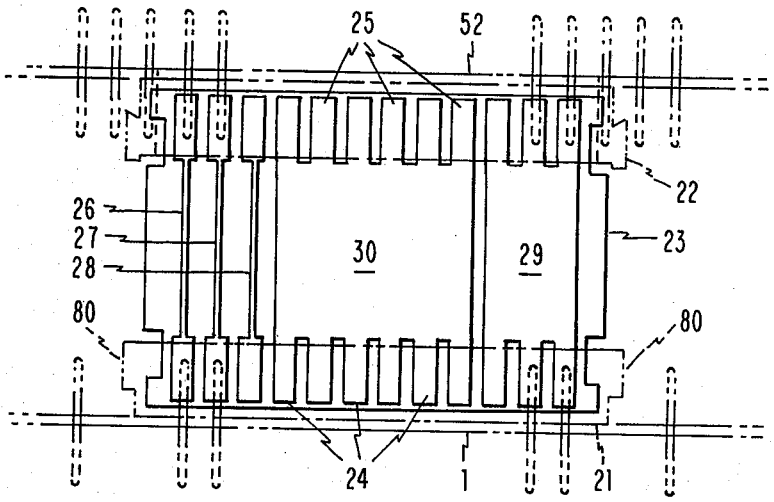
FIG. 2 is a side view of the interposer showing the connectors and boards in phantom form.

Each interposer 20 has a first connector 21 and a second connector 22 spaced by a rigid epoxy glass laminate element 23 which carries conductors interconnecting connector 21 and connector 22. FIG. 2 shows interposer 20 in more detail. First connector 21 is shown by dotted lines as is second connector 22 so as to facilitate the showing of the lands 24 and 25 which are used to made a solder connection to the contacts in connectors 21 and 22 respectively. Laminate element 23 has lands on both sides to accommodate connection to the contacts which are arranged in two parallel rows.

The use of a laminate element 23 such as shown in FIG. 2 allows the system to accommodate a variety of conductor sizes to provide shielding and non-standard impedance matching which is not available with standard multi-wire cables. For example, the conductors 26, 27 and 28 are relatively thin and widely spaced to handle signals. The opposite side of element 23 may have a solid area such as that shown at the other end of element 23 and identified as ground plane 29. The size of conductors 26, 27 and 28, the thickness and dielectric constant of the laminate are parameters which can be manipulated to provide the desired impedance for signal lines 26, 27 and 28.

Where it is desired to handle high current, a large conductive area such as shown at 30 can be included. It will be appreciated that the usual situation would require only a few high current connections and these would be standardized as power interposers with two or three large power conductors and no signal conductors. Other standard interposers would be used to convey signals.

Returning now to FIG. 1, an array board 50 is shown. In some respects array board 50 resembles the combination of planar board 1 and stiffener 11. For example, both have an epoxy glass laminate board affixed to a stiffening structure. However, in the case of array board 50, substantially the entire surface of the board is filled with conductive pins extending through the board but not visible in the drawing. The pins are arranged according to the same general geometric pattern as the pins 3 in the planar board 1 except that no pins are omitted in the area where the interposers are plugged in. As a further point of similarity, the epoxy glass laminate board in array board 50 is fastened to the molded plastic stiffener. The surface of array board 50 which faces planar board 1 is not shown since it is simply a pattern of conductive pins similar to pins 3 and spaced in the same general fashion.

Figure 5:
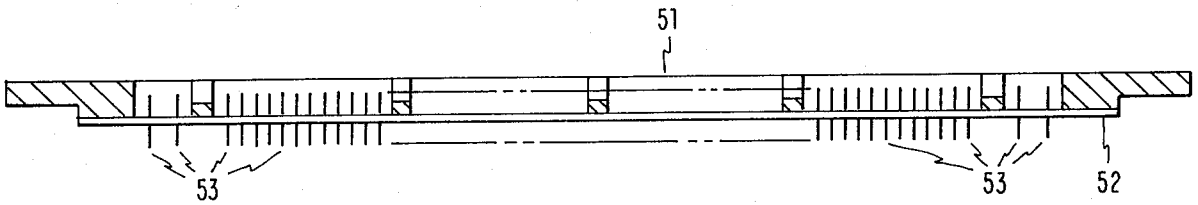
FIG. 5 is a sectional view of the array board taken along the line V—V in FIG. 1.

Array board 50 is shown in the sectional view of FIG. 5. The array board includes the molded plastic stiffener portion 51 and the epoxy glass laminate portion 52 which are bonded together with an adhesive to make a unitary structure. The contact means such as pins 53 are affixed to the laminate portion 52 by suitable means such as soldering to plated-through holes.

It can be seen with reference to FIGS. 1 and 5 that connectors 22 of interposers 20 can be plugged into the portion of pins 53 which project from the lower surface of array board 50. After all the interposers 20 have been plugged in, the retainer members 60 and 65 may be mounted on the array board 50. Incorrect assembly of the interposers 20, retainers 60 and 65 is prevented by polarizing the connectors 22 and the use of polarized dowel pins 61 and 62 on retainer 60 and polarized dowel pins 66 and 67 on retainer 65. Pins 61 and 62 are different sizes and designed to match holes 63A and 64A respectively. Pins 66 and 67 on retainer 65 are different sizes and designed to match holes 68A and 69A. Since dowel pins 61 and 66 are larger than dowel pins 62 and 67 correct orientation of the entire assembly is assured. It will be noted that both printed circuit board 1 and stiffener 6 have corresponding alignment holes 63B, 63C, 64B, 64C, 68B, 68C, 69B and 69C to ensure proper assembly of all components.

Since the center to center spacing of the pins 3 in the planar board 1 and the pins 53 in the array board 50 is the same, it would be possible to plug either end of interposers 20 on to the array board. However, as shown in FIG. 2, this is prevented by shoulders 80 on the connector 21 which plugs into the planar board. Since the pattern of pins 3 in planar board 1 has two pins omitted in the space between the pins associated with adjacent connectors, there is no obstruction when connector 21 is plugged to board 1. However, if connector 21 is turned toward array board 52 the shoulders 80 are obstructed by pins 53 since a full pattern of pins is present on this board.

On the other hand, no such shoulders exist on connector 22 which has relieved portions 81 instead of shoulders 80. The relieved portions 81 provide clearance for those of pins 53 which lie between the sets mating with connector 22, thereby allowing only connector 22 to be plugged to array board 52.

Further protection is required to prevent reversal of the orientation of connector 22 as it is plugged to array board 52 since there are two ways which are possible if the pins 53 are considered alone.

Figure 3:
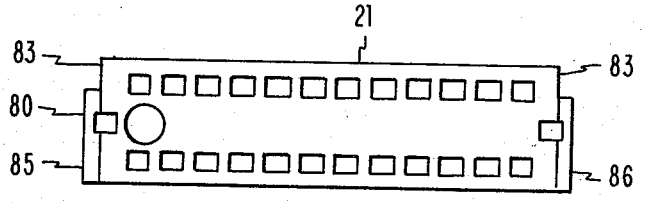
FIG. 3 is an end view of the interposer showing the first connector means.
Figure 6:
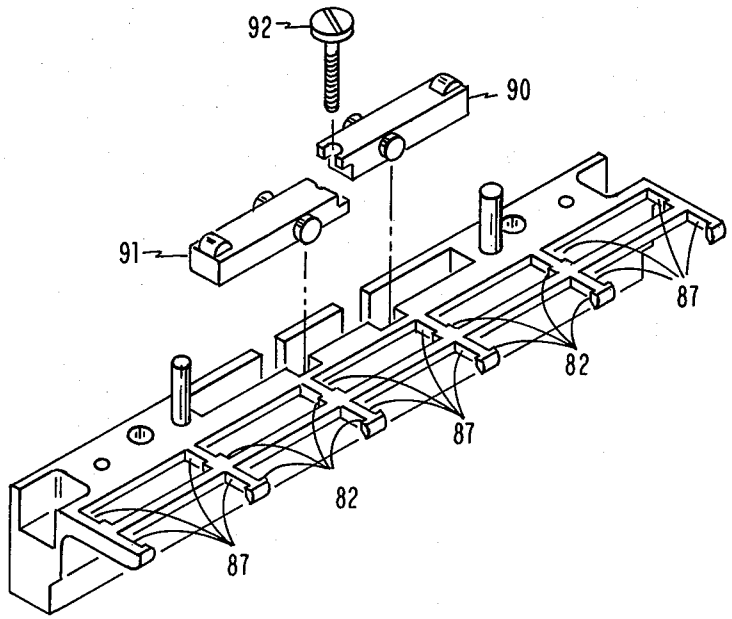
FIG. 6 is an exploded isometric view of the retainer means showing the two extractor levers and the actuating screw.

With reference to FIG. 3 and FIG. 6 it can be seen that small rectangular projections 82 exist in two corners of the apertures which receive connectors 21. This projection mates with the complementary notches 83 in connector 21. Thus, if the connector 22 is plugged onto array board 52 in the incorrect orientation, the connector 21 will not match the opening in retainer 60. When this condition exists, retainer 60 cannot be mounted on the array board 50 and the offending interposer must be reversed to align projection 82 and notch 83.

Shoulders 85 and 86 are spaced to engage web portions 87 shown in FIG. 6. The webs 87 prevent connector 21 from passing through the retainer 60 while permitting connector 21 to mate with the appropriate pins 3 on planar board 1.

Screws 88 pass through slots in array board 50 into threaded holes in retainer 60 to hold retainer 60 and the interposers against array board 50. Screws 89 pass through slots at the opposite end of array board 50 into threaded holes in retainer 65 to hold retainer 65 and the interposers against array board 50.

From this it can be seen that the array board 50 and the interposers 20 are held in engagement by retainers 60 and 65 to form a single structure which can be plugged into the planar board in a single orientation only.

Figure 7:
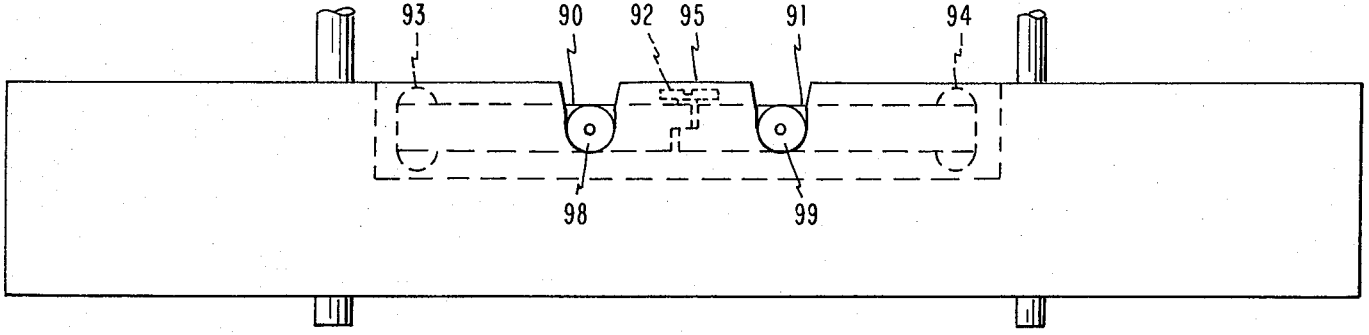
FIG. 7 is a partial side view of the retainer showing the extractor levers in the retracted position.
Figure 8:
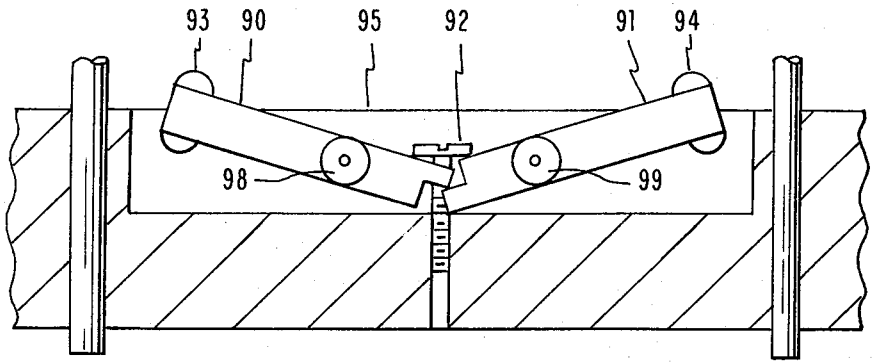
FIG. 8 is a partial section view of the retainer showing the extractor levers in the extended position.

Removal of the planar board 1 is easily accomplished by means of the screw actuated cofunctioning counter-rotating levers 90 and 91 shown in FIGS. 6, 7 and 8. In the retracted position of FIG. 7, screw 92 is in a position where it does not bear against levers 90 and 91. Thus, curved bearing surfaces 93 and 94 lie below the surface 95 of retainer 60 and therefore also the planar board 1 which abuts this surface.

When screw 92 is driven into retainer 60, levers 90 and 91 counter-rotate on trunnions 98 and 99. This causes levers 90 and 91 to move into the position shown in FIG. 8. As this happens, the curved bearing surfaces 93 and 94 bear against planar board 1 and gradually and uniformly eject the board from connectors 21 in symmetrical fashion. It will be noted that levers 90 and 91 are identical despite the fact that they rotate in different directions. This allows a single part to be used in both places.

What is claimed is:

1. In an electronic system having a plurality of printed circuit cards and a planar printed circuit board with a plurality of transversely projecting contact means, means for connecting said cards to said planar printed circuit board comprising:

elongated interposer means having first connector means at one end thereof for mating with contact means on said planar printed circuit board and a polarized second connector means at the opposite end thereof, an array board having contact means matched to said polarized connector means and connected to further contact means on said array board, said further contact means adapted to receive a printed circuit card connector, and means for disengaging said planar board from said interposer means including a pair of cofunctioning counter-rotating levers pivotally mounted on said array board and adapted to engage the abutting surface of said planar board to remove the planar board contact means from said connector means.

2. A system according to claim 1 wherein said means for disengaging said planar board includes two pair of cofunctioning counter-rotating levers pivotally mounted at opposite ends of said array board and adapted to engage the abutting surface of said planar board to remove the planar board contact means from said first connector means.

3. A system according to claim 2 wherein said levers are screw actuated.

4. An electronic system having a plurality of printed circuit cards comprising a planar board with a plurality of transversely projecting contact means, means for connecting said cards to said planar board, elongated interposer means having first connector means at one end thereof for mating with the contact means on said planar board and a polarized second connector means at the opposite end thereof, an array board having contact means matched to said polarized second connector means and connected to further contact means on said array board, said further contact means adapted to receive a printed circuit card connector, and means for disengaging said planar board from said interposer means including a pair of cofunctioning counter-rotating levers pivotally mounted on one of said array board and said planar board and adapted to engage the abutting surface of the other of said array board and said planar board to interrupt electrical contact between said array board and said planar board.

5. A system according to claim 4 wherein said means for disengaging said planar board from said interposer means includes two pair of cofunctioning counter-rotating levers pivotally mounted at opposite ends of said one of said array board and said planar board and adapted to engage the abutting surface of the other of said array board and said planar board.

6. A system according to claim 5 wherein said levers are screw actuated.

* * * * *